US006917306B2

(12) United States Patent
Lilja

(10) Patent No.: US 6,917,306 B2
(45) Date of Patent: Jul. 12, 2005

(54) RADIO LINKED VEHICLE COMMUNICATION SYSTEM

(76) Inventor: Craig K. Lilja, 528 Bonito Ave., Imperial Beach, CA (US) 91932

( * ) Notice: Subject to any disclaimer, the term of this patent is extended or adjusted under 35 U.S.C. 154(b) by 69 days.

(21) Appl. No.: 10/692,551

(22) Filed: Oct. 23, 2003

(65) Prior Publication Data

US 2005/0093717 A1 May 5, 2005

(51) Int. Cl.[7] ..... G08G 1/07

(52) U.S. Cl. ..... 340/903; 340/906; 340/902; 340/988; 340/905; 340/436; 340/473; 340/991; 701/33; 701/117; 701/301; 701/213

(58) Field of Search ..... 340/903, 906, 340/902, 988, 905, 436, 473, 991; 701/33, 117, 301, 213

(56) References Cited

U.S. PATENT DOCUMENTS 6,252,519 B1 6/2001 McKenna
6,326,903 B1 12/2001 Gross et al.
6,516,273 B1 2/2003 Pierowicz et al.
6,831,572 B2 * 12/2004 Strumolo et al. ..... 340/903
6,859,147 B2 * 2/2005 Buscemi ..... 340/902
2001/0038344 A1 11/2001 Garcia
2002/0008635 A1 1/2002 Ewing et al.
2003/0016130 A1 1/2003 Joao
2003/0052796 A1 3/2003 Schmidt et al.

* cited by examiner

*Primary Examiner*—Tai T. Nguyen
(74) *Attorney, Agent, or Firm*—Donn K. Harms

(57) ABSTRACT

A radio linked vehicle communication system for text messaging, traffic light control, resource management and traffic monitoring, designed to establish the location of emergency vehicles and related privately owned vehicles within their vicinity and have this information relayed to a third party using conventional electronic devices. Specifically to notify the privately owned vehicle or vehicles in close proximity of an emergency vehicle of their presence, so as to avoid possible accidents and to relay this information to a third party to be recorded and verified. Additional benefits of the system would be the ability of having interrogators, either mobile, aircraft of in a fixed location that could identify and personalize specific vehicles for investigation purposes and to provide a mobile repeater system.

15 Claims, 4 Drawing Sheets

RADIO LINKED VEHICLE COMMUNICATION SYSTEM

FIELD OF THE INVENTION

This invention relates to the field of devices used to establish the location of emergency vehicles and related privately owned vehicles within their vicinity and to have this information relayed to the appropriate parties. Specifically, it is used to notify the privately owned vehicle or vehicles in close proximity to an emergency vehicle of the emergency vehicle's proximity, so as to avoid possible accidents and to relay this and identifying information to a third party to be recorded and verified.

BACKGROUND OF THE INVENTION

Operation of a motor vehicle anywhere in the world has become increasingly hazardous with the advent of the smaller, faster cars in combination with the larger cars, SUV's, small trucks, large trucks and other motor vehicles that have to be on the roads today. The act of policing and controlling the increasing volume of vehicles on the road has become a monumental task. Only through the aide of computers and computer aided emergency vehicles could the task of monitoring and identifying ever increasing numbers and types of motor vehicles be possible. Emergency vehicles including police cars, emergency medical service vehicles and fire fighting vehicles require short response times to be more effective. Such response times require that emergency vehicles proceed through traffic and intersections with great haste. Commonly, the only knowledge private vehicle operators have of a visually identifiable emergency vehicle is the flashing lights and siren. When the emergency vehicle is not visible to other drivers, the only hint to their presence is conventionally the sound of a siren. Such sounds can be deceiving as to the direction of travel and location of the emergency vehicle due to the bounce effect in cities and due to the potential of multiple emergency vehicles traveling in diverse directions to the same destination.

If the operator of a privately owned vehicle has early knowledge of approaching emergency vehicles, the threat of an accident decreases and the effectiveness of the emergency personnel in timely reaching their destination increases. All emergency services recognize this fact and most people consider response time when talking about public safety and living conditions in an area. Systems currently in place use a combination of audio and video stimuli to notify the surrounding vehicle traffic of approaching emergency vehicle traffic. These systems are hampered by many conditions; rain, fog, wind, speed of the vehicles and traffic conditions. Also the audio/video alert system, or siren, has to compete for the private vehicle operator's attention by overcoming the car stereo system or the talking passengers or the cell phone. One might also consider modern soundproofing of vehicles blocking noise exterior to the cabin interior to be detrimental to the effectiveness of sirens. This coupled with the fact that many drivers just don't pay attention to adjacent street traffic and their rear view mirror while driving is a further detriment to recognition of approaching emergency vehicles.

As noted, emergency vehicles approaching intersections depend upon sirens, horns, bells, or other types of audible and/or visible warning devices to alert other people of their presence especially in the area of the intersection of two or more roads. This has not always proven to be a completely successful technique with emergency vehicles, though it is still the standard mode of operation today. Unfortunately accidents involving emergency vehicles often occur at intersections due to confusion, impaired hearing, inattention, noise conditions or overly aggressive drivers seeking to clear the intersection before the arrival of the emergency vehicles. Very dangerous problems are often caused when multiple emergency vehicles are approaching the same intersection and cannot hear each others siren because of their own.

In 2000 1.2 million cars were stolen in the U.S. Sixty-two percent of the stolen vehicles were recovered but most of those had received damage. The thieves target late model popular cars for the parts and resale value. The cost of replacing or repairing stolen vehicles is a huge burden upon the insurance industry and ultimately upon all drivers. By stopping theft and recovering stolen vehicles quickly crime is mitigated and insurance rates decrease.

Ever since the terrorist attacks of Sep. 11, 2001 the Department of Homeland Security has been trying to preempt any further attacks. Part of accomplishing this is identifying possible terrorists and monitoring their actions for suspicious activity which may indicate attack planning. By being able to easily monitor suspect vehicles the Department of Homeland Security becomes more efficient and the terrorist threat is diminished.

Cameras have been used to monitor parking lots for years. They are used to identify thieves and criminals as they leave the seen of the crime. Often criminals are able to thwart the cameras by altering or covering their license plates. By being able to accurately identify vehicles in parking lots, criminals are more easily apprehended since they may be associated with individual vehicles captured on the camera and stolen vehicles recovered since they are easily uniquely identified.

This device and method herein disclosed describes a new and unique system designed to decrease the response time of emergency vehicles, increase the safety of surrounding private vehicles, both of which will result in the saving of many lives. While decreasing the response time of emergency vehicles is important, this system has many operational characteristics that could also be employed for the security and defense of the general public.

PRIOR ART

U.S. Pat. No. 6,252,519 (McKenna) describes an emergency vehicle signaling system wherein an emergency vehicle transmits an RF signal having a narrow cone calculated to be received in a second vehicle. The receiver for the second vehicle is equipped with an indicator in the form of a light which blinks in order to alert the driver of the emergency vehicle from the RF signal which it is transmitting which has been received by the second vehicle. Accordingly, occupants of the second or non-emergency vehicle are made aware of the presence of the emergency vehicle while the visual indicator confirms reception of the RF signal. Mckenna however does not disclose a means of communication between emergency vehicles or interrogators and privately owned vehicles or suggest the particular intricacies of the communication between the emergency vehicle and the privately owned vehicle and a third party base station.

U.S. Pat. No. 2001/0038344 A1 of (Garcia) teaches of an alarm system for alerting drivers and passengers of non-emergency vehicles to the approximate presence of an emergency vehicle which may be approaching the particular non-emergency vehicle. In one embodiment, an alarm, such as a blinking light or the like, is generated within the non-emergency vehicle or non-emergency vehicles. In another embodiment, a positioning system is also provided and displays the approximate position of the emergency vehicle, such that the driver or passengers of the non-emergency vehicle or vehicles may be apprised of the presence of and approximate location and direction of that emergency vehicle. The Garcia patent does not teach any means of communication between emergency vehicles or interrogators and privately owned vehicles in the same fashion or suggest the particular intricacies of the communication between the emergency vehicle and the privately owned vehicle and a third party base station described within the forgoing patent.

U.S. Pat. No. 6,326,903 B1 (Gross) discloses a system that allows operators of emergency vehicles to obtain graphic data regarding other emergency vehicles that may pose threats of collision. Automatic signaling takes place between emergency vehicles within range of each other to transmit directional data regarding the direction of travel of each emergency vehicle. This data is correlated to derive directional vectors relative to each other. These vectors are displayed so that the operator can quickly determine the direction of other vehicles with respect to his own. The system includes equipment for preempting traffic signals by selected emergency vehicles, and for informing other emergency vehicles that a traffic signal has been preempted. Gross however deals with the communication between two or more emergency vehicles and their respective location with each other and does not involve the communication with privately owned vehicles, interrogators or a base third party base station.

U.S. Pat. No. 2003/0016130A1 (Joao) additionally describes a control apparatus and method, including a first control emergency vehicle, located at a vehicle or premises, capable of controlling one or more of a plurality of at least one of a respective system, equipment system, component, device, equipment, and appliance, of a respective vehicle or premises, with a first signal. The first control device generates and/or transmits the first signal in response to a second signal generated by and/or transmitted from a second control emergency vehicle located remote from the vehicle. The second signal is automatically received by the first control device. The second control device generates and/or transmits the second signal in response to a third signal generated by and/or transmitted from a third control device located remote from the vehicle and the second control device. The third signal is automatically received by the second control device. Joao, much like the previous prior art, does not disclose the means of communication between emergency vehicles or interrogators and privately owned vehicles in the same fashion or suggests the particular intricacies of the communication between the emergency vehicle and the privately owned vehicle and a third party base station.

U.S. Pat. No. 2002/0008635 A1 (Ewing) teaches a warning system for alerting the driver of a private vehicle that an emergency vehicle is approaching. The system includes a receiver and a display panel mounted in the private vehicle, and at least two infrared receivers mounted on the private vehicle. The display panel mounted in the private vehicle includes an indicator that alerts the driver of the private vehicle to the approaching emergency vehicle as well as the direction to move in order to yield the right of way to an approaching emergency vehicle. A warning signal mounted in the emergency vehicle provides signals that allow the components of the emergency vehicle warning system mounted in the private vehicle to know that the approaching vehicle is an emergency vehicle. Ewing is involved with communicating between emergency vehicles and privately owned vehicles and it does not bring into play a interrogator, either mobile, aircraft or fixed location, and does not include the additional communication between a base station.

U.S. Patent No. US 6,516,273 B1 (Pierowicz et al.) relates to a system installed in a vehicle to: determine the location of the vehicle; identify each intersection as the vehicle approaches the intersection; determine the presence and type of traffic control device at that intersection; determine whether the traffic control device associated with the intersection in the direction of travel of the vehicle requires the vehicle to come to a complete stop; determine the acceleration required to stop the vehicle prior to its entry into the intersection; and, if the required acceleration exceeds a predetermined threshold alerts the driver by means of an aural, visual and/or haptic indication, to brake the vehicle prior to its entry into the intersection. The system may also preempt driver control of the breaking system and begin breaking the vehicle automatically prior to its entry into the intersection. In another embodiment of the invention, the system may determine the phase of the traffic light via a communications channel between the vehicle and the traffic light, repetitively check to see if the vehicle is entering the intersection in contravention of the traffic light's indication, and, if the vehicle does so begin to enter the intersection, then alerts the driver by means of an alarm or indication to brake the vehicle prior to its entry into the intersection. Ewing too lacks a means of communication between emergency vehicles or interrogators and privately owned vehicles in the same fashion or suggests the particular intricacies of the communication between the emergency vehicle and the privately owned vehicle and a third party base station described within the forgoing patent.

U.S. Pat. No. 2003/0052796 A1 (Schmidt et al.) describes a system for controlling vehicles within a traffic network. The vehicles have means for communication via a communication network, with a service mediator system, linking the vehicle's communication means to various servers. The vehicle may include a means for exchanging data between the vehicles' software or hardware, while at least one of servers includes a means for processing said data related to the vehicles' software or hardware, like fuel consumption and the vehicles' maintenance state. This is also another patent that does not disclose any means of communication between emergency vehicles or interrogators and privately owned vehicles in the same fashion or suggests the particular intricacies of the communication between the emergency vehicle and the privately owned vehicle and a third party base station described within the forgoing patent.

Thus there is a continuing need for improving the means of communication and mutual identification between emergency vehicles and privately owned vehicles especially when the emergency vehicles are on a code 3 call which requires the fastest possible travel time using red lights and siren. None of the foregoing prior art teaches or suggests the particular intricacies of the communication between the entities or their relationship with a third party base station described within the forgoing patent. In this respect, before explaining at least one embodiment of the invention in detail it is to be understood that the invention is not limited in its application to the details of construction and to the arrangement, of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting the device herein disclosed.

SUMMARY OF THE INVENTION

A preferred embodiment of this invention consists of a radio linked interactive vehicle communication system for text messaging, traffic light control, resource management and traffic monitoring. It is best designed to establish the location of emergency vehicles and related privately owned vehicles within their current or future vicinity and to have messages relayed to the private vehicles as well as to a third party using conventional electronic devices. Specifically, the disclosed device alerts the privately owned vehicle or vehicles within a determined proximity of an emergency vehicle of their presence. This alert helps to avoid accidents and also allows for the additional relay of this information to a third party to be recorded and verified. Additional benefits of the system would be the ability of having electronic interrogators which transmit a signal which when received causes a determined response to be transmitted in return. The interrogators can be either mobile, aircraft or in a fixed location and once initiated could identify and personalize the identification of specific vehicles for investigation purposes.

The disclosed system installed in the emergency vehicle will include the interrogator system (transceiver and associated data processor), antenna, compass, or other means for directional travel determination, GPS receiver or other means for location determination, a computer and a user interface. The computer also would accept speed data from the vehicle in which it is installed.

Interrogators installed as fixed units may be installed at any location but typically are located at parking lots, border crossings or other areas of high traffic or vehicle congregation which may be of high interest.

The system installed in the privately owned vehicle will include the transponder (transceiver and associated processor), antenna and compass or other means to determine directional travel of the private vehicle such as a GPS unit or magnetometer. A means to determine the private vehicle speed can also be employed to aid in calculation of current and future location of the individual vehicle.

Transponders may also be installed as fixed units at any location but are typically installed at intersections as part of the traffic light control system and communicate information received to the traffic control system controlling the signal lights.

The primary components of the base station controller consist of the transceiver, antenna, computer and user interface to allow data input and review. These are typically located at dispatch locations. Base stations are typically controlled by the dispatcher but may be accessed remotely via telephone line or other communication system such as by radio link.

Any number of agencies may upload the base station controller computer with data on the identification regarding specific vehicles that may be of interest. For instance, the police may have a list of stolen vehicles that are wanted, while the Department of Homeland Security may have lists of vehicles of which it would like to know the whereabouts due to suspected terrorist activity. The base station controller can download these lists to emergency vehicles and maintain the data stored in each remote emergency vehicle computer automatically or when cued to do so. Along with the lists sent to the emergency vehicles is any other pertinent data that the system and operators may require. For instance, if a police vehicle finds a stolen car, the officer may be notified of the year, make, color, license plate and owner. But if an emergency medical service vehicle happens to identify a stolen vehicle, the emergency vehicle personnel wouldn't be notified. Instead the appropriate dispatcher is notified by a relay of that information from the emergency vehicle through the controller computer. This would make the various emergency vehicles automatic roaming sensors or scanners for vehicles of interest in their proximity without the need to bother the emergency personnel in those vehicles.

Another example may be the case when an interrogator identifies a vehicle that the Dept. of Homeland Security is looking for. In this case a message with the vehicle identification and location will be sent to the appropriate agency autonomously, without any knowledge or action required on the part of the emergency vehicle operator or the dispatcher.

An emergency vehicle interrogator typically is powered up and operating whenever the vehicle is also operating. The interrogator controls all communications with each privately owned vehicle, controlling each transponder's transmissions. The interrogator continuously transmits a signal on a pilot channel that will be received by any transponder within the designated range or that signal. Each transponder in the current favored embodiment of the device is always operating, even when the vehicle is not being operated. The transponder monitors the pilot channel waiting to receive the pilot signal from any interrogator. Information received from the pilot channel triggers the transponder to begin communication with the interrogator. Each privately owned vehicle transponder replies to the interrogator, as directed by the interrogator, with information that includes as its unique identification and its compass reading. Once the interrogator has received a response from a transponder, it can signal the transponder that it has received its response to the interrogation. This establishes a communication link and the private vehicle transponder then waits for any further commands from the interrogator.

The interrogator is able to resolve the distance to the transponder by analyzing a round trip ranging signal which is initiated by the interrogator. This signal is received by the transponder and re-transmitted to the interrogator along with a delay metric. The delay metric represents the amount of time that the transponder takes to retransmit the ranging signal. The interrogator processor calculates the distance using the delay metric and the amount of time taken to receive the round trip signal. The emergency vehicle computer processes the data received from the transponder and determines if any more communication or data is required from that transponder. Determination is made based upon the heading and proximity of the privately owned vehicle relative to the emergency vehicle and metrics input to the computer by the emergency vehicle operator. For instance, the emergency vehicle operator may have determined that he only wants to message to privately owned vehicles that are within ±15° of the emergency vehicle heading, and within 1 mile ahead of the emergency vehicle. The emergency vehicle operator may also select multiple messages, each to be displayed under different conditions based upon the heading and distance relative to the emergency vehicle. For instance, private vehicles that are traveling in a similar direction to the emergency vehicle and are less than 1 mile ahead may be triggered to display one message to their driver, vehicles traveling perpendicular to the emergency vehicle and less than ½ mile away may be triggered to display a different message to their driver, while vehicles less than 1 mile behind the emergency vehicle may be caused to display yet another message to their drivers, and those traveling opposite to the emergency vehicle may be ignored and display no message at all to their drivers.

The displayed message viewed by the individual private vehicle drivers may be one that is preprogramed into the transponder or it may be one that is composed by the emergency vehicle operator. In either case the emergency vehicle operator has complete control of which message to send to which vehicles based upon their proximity and heading relative to the emergency vehicle. Along with any text messages for display there may be transmitted other commands for stereo muting or audio/video alerts through the private vehicles audio or video system. Additionally, the emergency vehicle interrogators are able to communicate with one another to coordinate communications to privately owned vehicles and traffic light control.

Also, due to the fact that the emergency vehicles are able to automatically communicate with the base stations, emergency vehicle resources can be readily tracked and managed in an extremely efficient manner. This also facilitates recording of position data for later use.

It needs to be noted that many embodiments of the transponder antenna system exist and use of multiple antennas to determine the location of a specific transmitter is common practice. While one antenna and one receiver will work in this system, the more antennas, and possibly receivers, that are used will yield more precise location and directional information. There are no set guidelines for a multi-antenna system that may be used and anyone who is skilled in the art could design any number of systems that would work equally well. A very common system for determining direction is a diversity system where the phase of a signal received from two or more antennas is compared. Another system may employ RF director and/or reflector antenna elements and/or a rotating antenna. As such, those skilled in the art will appreciate that the conception upon which this disclosure is based may readily be utilized as a basis for designing of other structures, methods and systems for carrying out the purposes of the present invention. It is important, therefore, that the claims be regarded as including such equivalent construction insofar as they do not depart from the spirit and scope of the present invention.

THE OBJECTS OF THE INVENTION

An object of this invention is to identify and to send a message to other remote vehicles within a determined vicinity of emergency vehicles.

Another object is the ability of the emergency vehicle to selectively message using either or both of video or audio means to privately owned vehicles based upon that vehicles heading and individual proximity to the emergency vehicle.

An additional object of this radio linked vehicle communication system for text messaging, traffic light control, resource management and traffic monitoring is to allow emergency vehicles to remotely identify private vehicles electronically, not requiring them to read the license plate.

Yet another object of this invention is to allow emergency vehicles to control the traffic on roadways as well as the traffic lights at specific intersections when they are approaching during an emergency call.

A further object of this invention is to establish the precise location of the emergency vehicles and the related private vehicles within the vicinity of the emergency vehicle and have this information relayed to a third party.

Another object of this invention is to record and verify the information involved with an emergency vehicle on a specific emergency call.

Still another object of this invention is to allow authorities to identify stolen vehicles more readily, either from an emergency vehicle or from an airplane, helicopter or by fixed interrogators located in parking lots or elsewhere, without having to approach the suspect vehicle.

Yet another object is to coordinate the control of traffic lights when multiple emergency vehicles are approaching.

A still further object of this invention is to alert the drivers of private vehicles that they are in the vicinity of an approaching emergency vehicle on a call.

Yet still another object of this invention is to use the dispatch station or to create a central control station that will monitor, control, record and relay information to and from the respective vehicles.

A further object of this radio linked vehicle communication system for text messaging, traffic light control, resource management and traffic monitoring, is to create a safer environment on the streets for the operators of private vehicles as well as for the operators of emergency vehicles and for pedestrians.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
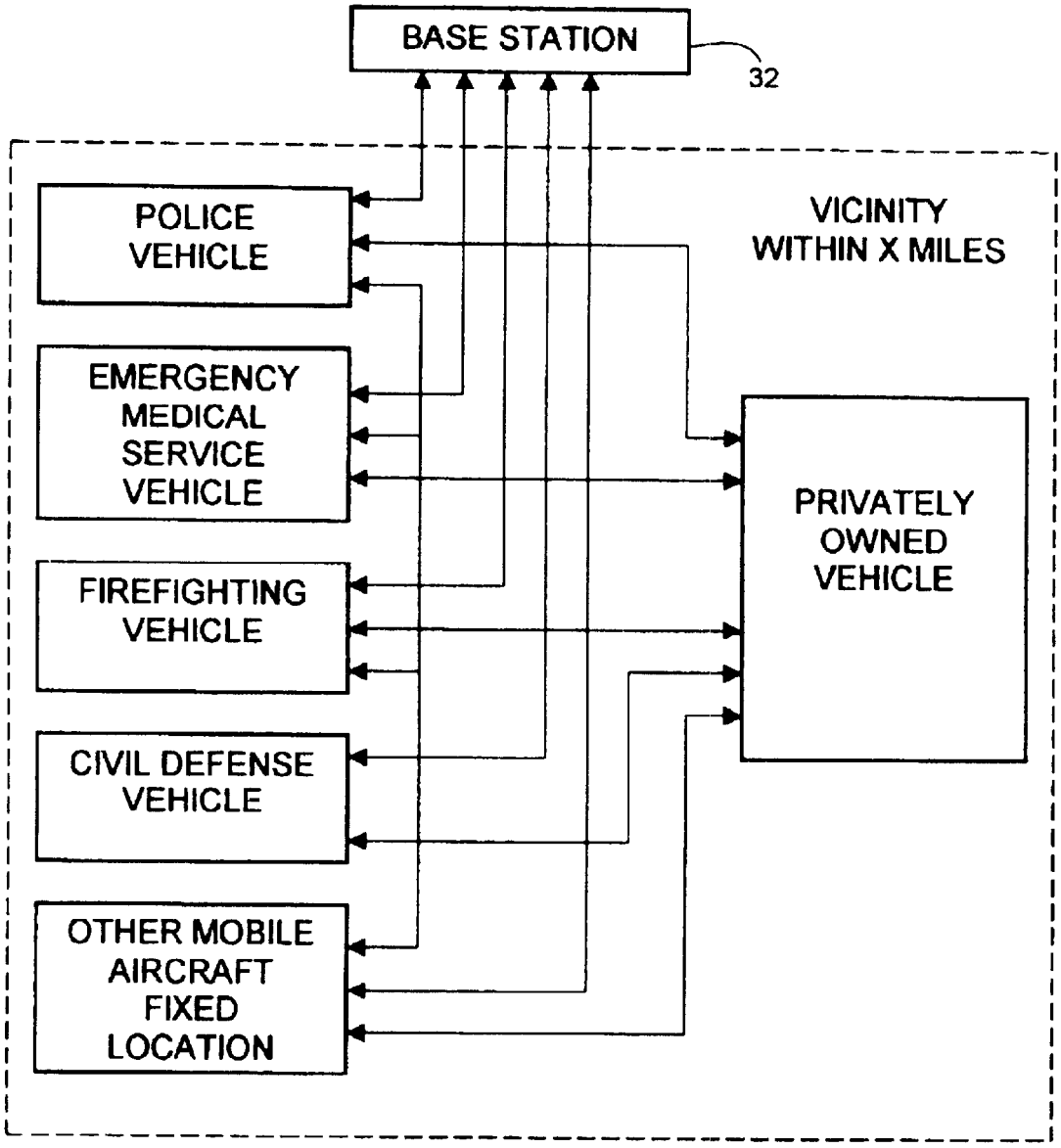
FIG. 1 is a diagram of the communication between the police vehicle, emergency medical service vehicle, firefighting vehicle and other mobile aircraft fixed location with each other, the base station and the privately owned vehicle of the patent herein disclosed.

Referring now to the drawing FIGS. 1–5, wherein similar parts of the invention are identified by like reference numerals, there is seen in FIG. 1 a diagram of the various communication pathways of the disclosed system 10 showing the communication paths between the different elements within the system 10.

In the simplest mode of the device 10 a first component 12 is mounted in the private vehicle and communicates with the vehicle power supply for appropriate electrical power. The first component 12 will include the transponder 14 which would include a transceiver to broadcast and receive radio transmitted data. An antenna 16 would communicate with the transceiver to transmit and receive by radio waves.

Also included in this first component 12 would be a means to determine directional travel of the private vehicle shown as direction sensor 18 such as one or a combination of devices including a compass, GPS unit or magnetometer. A means to determine the private vehicle speed can also be optionally employed to aid in calculation of future location of the individual vehicle. Also included in this vehicle mounted first component 12 would be a means for visual display of indicia shown as dashboard display 19 which would be a Liquid Crystal, cathode ray, Light emitting diode, or other screen type display.

A microprocessor or similar computing device 17 is programed with control functions to operate the individual parts of the first component 12.

A second component 22 of the system 10 would be mounted upon mobile emergency vehicles and communicate with the electrical system of that vehicle for the required power to operate the second component 22. An interrogator 20 of the second component 22 communicates with a computer 24 which is programed with the appropriate software for the operation herein described. Communicating with the computer is a means to determine the speed of the emergency vehicle shown as speed sensor 26 and a means to determine directional travel of the emergency vehicle shown as directional sensor 28. A user interface 30 such as a keyboard and monitor allows the user to input data and operational instructions to the computer 24 and a means to determine location such as GPS device 32 provides the computer 24 with real time location information.

Each transponder 14 in a current favored embodiment of the device 10 defaults to an operating or "on" condition and therefor would work best if always operating, even when the vehicle is not being operated. In operation in the simplest embodiment the transponder 14 monitors the pilot channel seeking to receive pilot signals from any interrogator 20 which is mounted on the second component 22 of the device 10 in one or a plurality emergency vehicles having such second components 22. Information broadcast by any interrogator 20 on the pilot channel will trigger the transponder 14 to begin communication with the interrogator 20 and to reply to the interrogator 20 in a manner directed by the interrogator 20, with information that includes a unique identification of the vehicle in which the responding first unit 12 is mounted and its direction of travel. Once the interrogator 20 has received the response from a transponder 14, it signals the transponder that it has received its response to the interrogation allowing the transponder 20 to cease. This handshake establishes a communication link between the private vehicle transponder 14 and the emergency vehicle mounted interrogator 20 and initiates the transponder 14 to wait for any further commands from the interrogator 20 as to data required.

The second component 22 is able to resolve the distance to the transponder 14 of the first vehicle mounted component by analyzing a round trip ranging signal transmitted by the interrogator 20. This signal is received by the transponder and re-transmitted to the interrogator along with a delay metric. The delay metric represents the amount of time that the transponder takes to retransmit the ranging signal and provides a means to determine distance of the first component 12 from the second component 22 and the distance between the respective vehicles in which they are mounted. The interrogator processor calculates this distance using the delay metric and the amount of time taken to receive the round trip signal. The second component's computer 24 processes the data received from the transponder 20 and determines if any more communication or data is required from that transponder 20.

A warning determination is determined by the computer 24 using onboard software suitable to the task based upon the heading and proximity communicated by the first component 12 in the privately owned vehicle relative to the second component 22 mounted in the emergency vehicle and metrics input to the computer by the emergency vehicle operator. Using predetermined criteria which may be included in the programming of the computer software or using the user interface 30, the operator of the emergency vehicle in which the second component is mounted can determine that it is necessary to warn or otherwise communicate with the vehicle in which the first component 12 is mounted. This need for the emergency vehicle to communicate with one or a plurality of other privately owned vehicles in which first components 12 are mounted and communicating with the second component 22 in the emergency vehicle is therefor determined by the computer 24 in the emergency vehicle based on data communicated to it. One or a plurality of different messages as to location, heading, and type of emergency vehicle in which the second component 22 is mounted can be broadcast to communicating transponders 14 in remote vehicles to warn them of the,presence of the emergency vehicle. If a warning is determined to be in order for any of the communicating transponders 14 it will be broadcast by the interrogator 20 to the vehicle and displayed to the occupant on the dashboard display 19. The warnings or non-warnings would vary based on the heading and proximity of the remote vehicles with transponders 20 and the heading and speed and location of the emergency vehicle with the second component 22 mounted therein. This makes the device 10 very adaptive to the conditions at hand and avoids warnings being transmitted to other vehicles outside the determined proximity and headings determined to require such a warning. This enhances the device's performance in that needless warnings, which could cause an accident themselves by distracting drivers, are avoided and provides a. means to eliminate warnings to remote vehicles not determined to require them.

The displayed message viewed by the individual private vehicle drivers may be one that is preprogramed into the transponder 20 or it may be one that is composed by the emergency vehicle operator in real time thereby providing an adaptive messaging system to allow the emergency vehicle to issue very precise warnings or information if needed during an emergency. In this simplest form of the device, the first component 12 communicating with an emergency vehicle mounted second components 22 would provide a real time, adaptive means to warn proximate vehicles as well as a means to eliminate such warnings or information transmissions to vehicles not within the parameters determined to require the warning.

In another preferred mode of the device 10 a third component would be provided in the form of a base station 32 and a traffic light controller 34. Also, each emergency vehicle having a second component 22 such as a Police Vehicle, Emergency Medical Service Vehicle, Firefighting Vehicle, Civil Defense Vehicle or Other Mobile Aircraft Fixed Location, is able to communicate with any of the base station or the other emergency vehicles, aircraft, of fixed location, to coordinate their individual and group communication with the privately owned vehicles having the first component 12 onboard as well as with the traffic light controller 34. Since the traffic light controller 34 controls the lights and signaling of traffic at intersections, it is especially important that the emergency vehicles communicate with each other as well as the traffic light controller 34 to only change the lights in a manner that will not result in a collision of emergency vehicles. It thus provides a means to control signal lights to prevent two emergency vehicles from changing the lights to green at the same time and prevents any collisions that this would cause between emergency vehicles.

The base station 32 as noted above is able to communicate with each emergency vehicle or mobile aircraft or fixed location independently. Each second component 22 in each emergency vehicle would have a unique identification code that would provide an electronic means to identify each emergency vehicle. Using this identification code as well as the information from the speed sensor 26 and direction sensor 28 and the location sensor 32, the base station can provide dispatchers with real time information on the location, speed, and direction of each emergency vehicle and also calculate a time of arrival for any of them to a designated destination. This provides dispatchers using a display of this information communicated from the base station 32 the ability to track and better allocate emergency resources.

In another preferred embodiment of the device 10 the second units 22 mounted in any emergency vehicle can also track and/or seek identification and location information about specific vehicles having the first component 12 operatively mounted therein. This tracking and reporting ability would be done in the background by the interrogator 20 and computer 24 communicating with the base station 32 and with individual vehicles having a first component 12. In one preferred mode of a means to track vehicles, the interrogator 20 would continuously emit a signal on the pilot channel causing any transponder 14 in range to respond with a unique identification number for the vehicle in which the transponder 14 is mounted. These identification numbers along with data as to the proximity of the reporting vehicle and its direction would be received by the interrogators 20 mounted in any emergency vehicle having broadcasting the signal on the pilot channel. Once received the identification number or code of individual vehicles along with their proximity to the emergency vehicle receiving the information along with the direction of travel of the individual identified vehicles can be transmitted to the base station. From a database in a computer at the base station, the individual identification number or code relayed from the interrogator 20 of the emergency vehicle would be compared, and if a stolen, lost, or otherwise identified vehicle of interest is found in the comparison, it could be further tracked by the base station 32 using one or a plurality of second units 22 in one or a plurality of emergency vehicles.

In this fashion, a moving web of interrogators 20 could continually seek out and report on vehicles which report an identification number or code showing they are stolen, are known to be driven by a terrorist, or are otherwise of interest to law enforcement. Further, once identified, a suspect vehicle could be tracked by this moving web using a plurality of different emergency vehicles to seek out and retransmit location, speed, and direction information on identified vehicles of interest. Further, if a second unit 22 is placed at a border or airport or parking lot, it could continually seek out vehicles that are identified as subjects of interest by law enforcement. Should it be desirous to limit the information received from transponders 14 reacting to the broadcasts from interrogators 20 which is relayed to the base station 32, a list of vehicle identification numbers or codes could be downloaded into the computer 24 of one or a plurality of emergency vehicles causing identification information of responding vehicles transponders 14 to only be re-transmitted to the base station 32 if it matches the downloaded numbers or codes. This method would allow for the base station 32 and dispatchers running it, to look for suspect private vehicles in a narrow search in a specific geographic area occupied by certain emergency vehicles, or to look throughout a city using every emergency vehicle having an interrogator 20. By allowing communication between all of the interrogators 20 mounted in all of the emergency vehicles, information transmitted from a interrogator 20 very remote from the base station 32 can also be relayed to the base station 32 through one or a plurality of emergency vehicles interrogators 20 situated between the very remote unit and the base station 32. This would help communications in hilly terrain or cities with large buildings.

Figure 2:
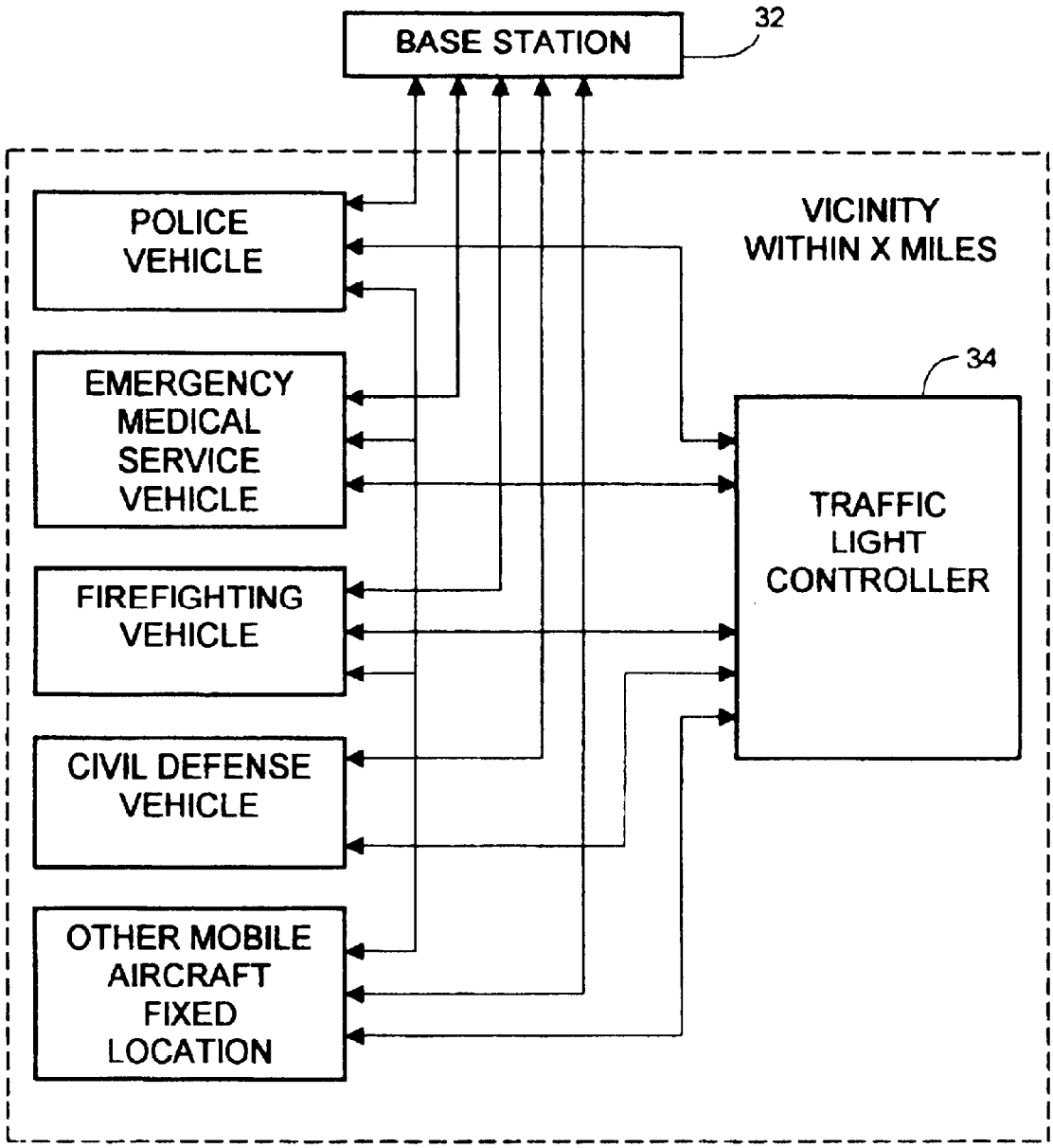
FIG. 2 is a diagram of the communication between the police vehicle, emergency medical service vehicle, firefighting vehicle and other mobile, aircraft or fixed location with each other, the base station system, and individual traffic light controller.
Figure 3:
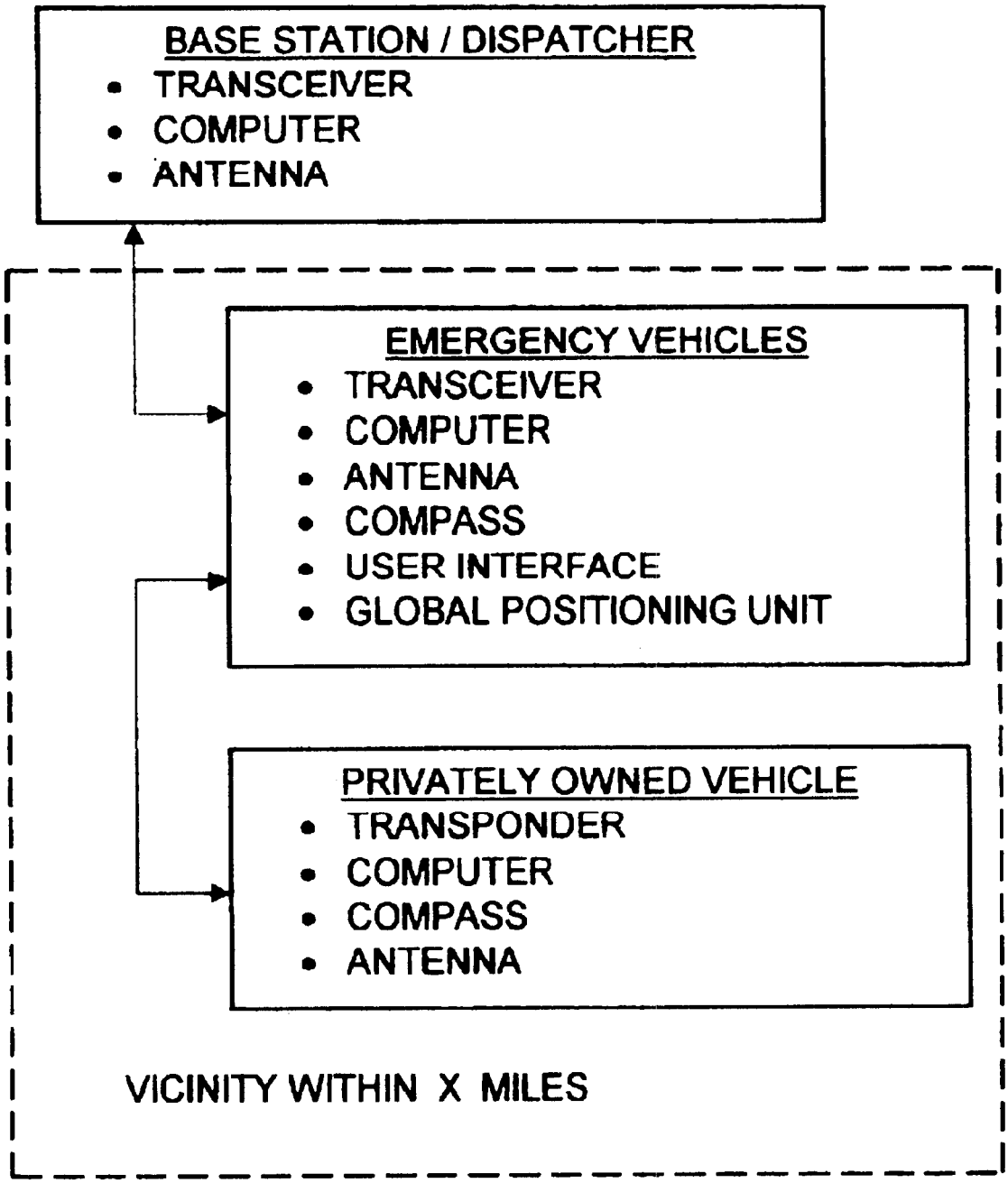
FIG. 3 is a diagram of the components of the Base station/dispatcher, emergency vehicles and privately owned vehicles and their relationship.
Figure 4:
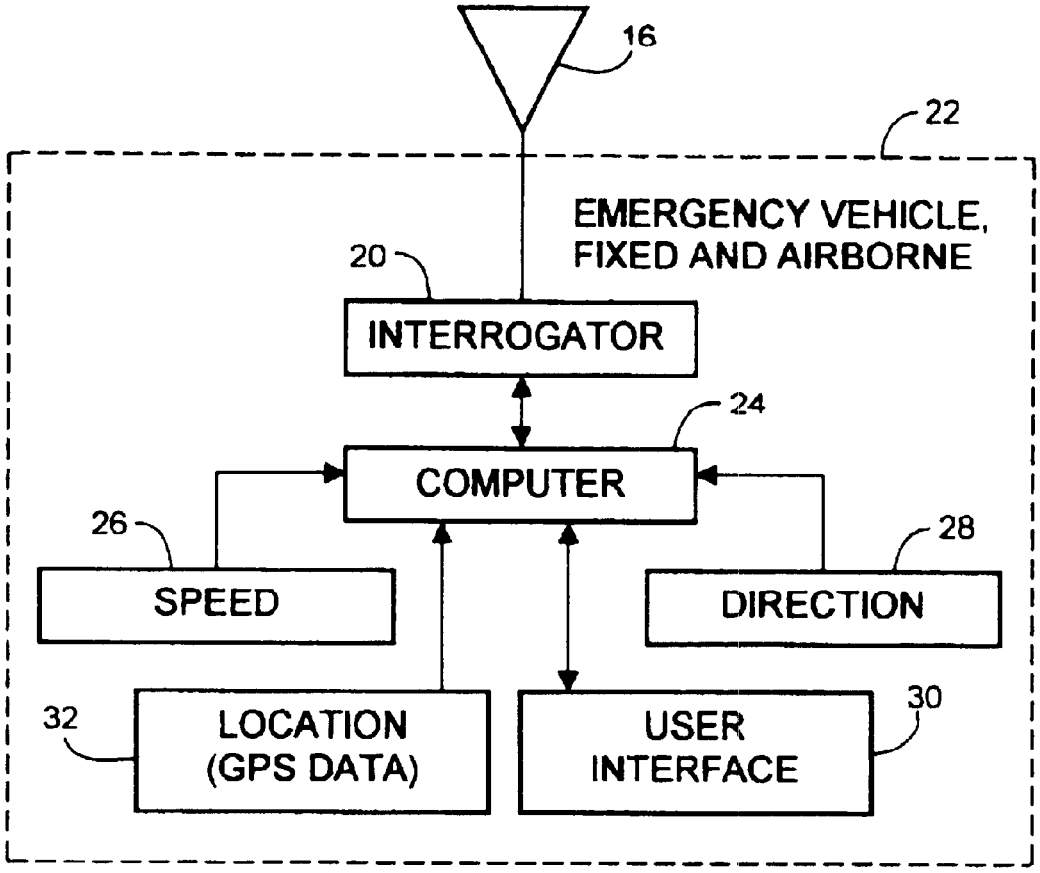
FIG. 4 is a diagram of the second component of emergency vehicle, fixed and airborne with the interrogator and computer and the information related to the computer.
Figure 5:
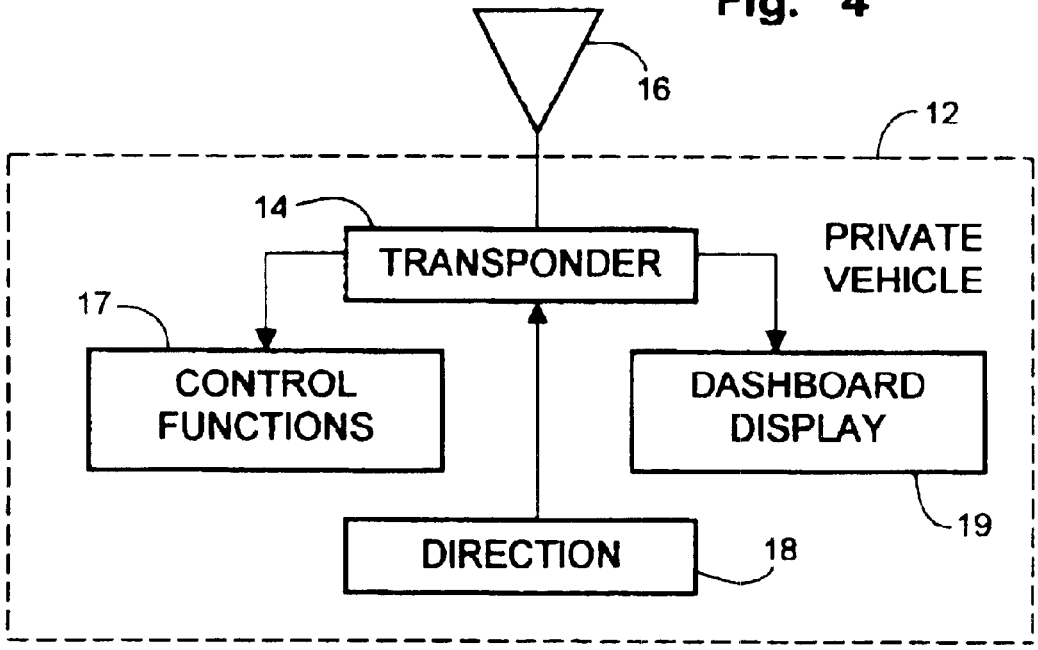
FIG. 5 is a diagram a first component for mounting in a private vehicle and the related components and information.

Finally, as shown in FIG. 2, because the second components 22 mounted in each of the emergency vehicles have the ability to transmit to each other as well as to the base station 32 and to also communicate with the traffic light controllers 34, they provide a means for the base station 32 to communicate with and operate individual traffic light controllers 34. This intercommunication between the various emergency vehicles essentially provides a repeater system to allow the base station 32 to send a message to any emergency vehicle that can be relayed to it through one or a plurality of the second components 22 in other emergency vehicles. Communicating with individual traffic light controllers 34 would also be done in the same fashion by sending out a control code via radio from the base station which will cause and individual traffic light controller to change the lights on an individual signal light. Using this individually coded signal, the base station can relay it through the system of second components 22 mounted in individual emergency vehicles who in turn would relay the control signal to the traffic light controller 34 for which the control signal is intended. This essentially provides a mobile repeater which uses one or a plurality of the emergency vehicles having second components 22 to receive and retransmit the signal from the base station 32 until it reaches its intended recipient.

The radio linked vehicle communication system for text messaging, traffic light control, resource management and traffic monitoring shown in the drawings and described in detail herein discloses arrangements of elements of particular construction and configuration for illustrating preferred embodiments of structure and method of operation of the present invention. It is to be understood, however, that elements of different construction and configuration and other arrangements thereof, other than those illustrated and. described may be employed for providing a radio linked vehicle communication system for text messaging, traffic light control, resource management and traffic monitoring in accordance with the spirit of this invention. Any and all such changes, alternations and modifications as would occur to those skilled in the art are considered to be within the scope of this invention as broadly defined in the appended claims.

What is claimed is:

1. A vehicle communication system comprising:

a first system component adapted for mounting in a first vehicle, said, first system component having a transceiver, means to determine the heading of said first vehicle, and means for visual display of indica to the driver of said first vehicle;

a second system component adapted for mounting in a second vehicle, said second system component having a computer, means to determine the directional travel of said second vehicle in communication with said computer, means to broadcast a pilot signal on a pilot channel and means to receive transmissions from said transceiver in operative communication with said computer;

said first system component having a default mode wherein said transceiver monitors said pilot channel for said pilot signal;

said first system component having a respond mode triggered by receipt of said pilot signal broadcast from said second system component;

said first system component having a display mode, triggered by a second signal from said second system component, wherein said visual display provides a visual warning of the proximity of said second vehicle to said driver of said first vehicle;

said first system component, in said respond mode, transmitting a response signal to said second vehicle component, said response signal including at least said heading of said first vehicle;

means for said second system component to determine the separation distance between said first vehicle and said second vehicle; and a trigger signal broadcast by said second system component, said trigger signal triggering said first system component to said display mode should said separation distance fall within predetermined separation parameters.

2. The vehicle communication system of claim 1 wherein said means for said second system component to determine the separation distance between said first vehicle and said second vehicle comprises:

a ranging signal transmitted by said second system component for receipt by said first system component;

a rebroadcasting of said ranging signal along with a delay metric by said first system component back to said second system component;

said delay metric being the amount of time said first system component takes to initiate said rebroadcasting; and said computer programed to calculate said separation distance from the total time the round trip transmission of said ranging signal and said delay metric.

3. The vehicle communication system of claim 1 additionally comprising:

said trigger signal suppressed should said heading of said first vehicle be away from the direction of travel of said second vehicle whereby said display mode of said first vehicle component is only triggered for first vehicles traveling toward or in the same general direction of said second vehicle.

4. The vehicle communication system of claim 2 additionally comprising:

said trigger signal suppressed should said heading of said first vehicle be away from the direction of travel of said second vehicle, whereby said display mode in said first vehicle component is only triggered for first vehicles traveling toward or in the same general direction of said second vehicle.

5. A vehicle communication system comprising:

a first system component adapted for mounting in a first vehicle, said first system component having a computer operatively programed and interfaced with a plurality of first system components including:

a transceiver;

means to determine the heading of said first vehicle;

means for visual display of indica to the driver of said first vehicle;

a second system component adapted for mounting in a second vehicle, said second system component having a computer operatively programed and interfaced with a plurality of second system components including:

means to determine the directional travel of said second vehicle;

means to broadcast a pilot signal on a pilot channel;

means to receive transmissions from said transceiver;

said first system component having a default mode wherein said transceiver monitors said pilot channel for said pilot signal;

said first system component having a respond mode triggered by receipt of said pilot signal broadcast from said second system component;

said first system component having a display mode, triggered by a second signal from said second system component, wherein said visual display provides a visual warning of the proximity of said second vehicle to said driver of said first vehicle;

said first system component, in said respond mode, transmitting a response signal to said second system component, said response signal including at least said heading of said first vehicle;

means for said second system component to determine the separation distance between said first vehicle and said second vehicle; and a trigger signal broadcast by said second system component, said trigger signal triggering said first system component to said display mode should said computer of said second system component determine said separation distance falls within predetermined separation parameters.

6. The vehicle communication system of claim 5 wherein said means for said second system component to determine the separation distance between said first vehicle and said second vehicle comprises:

a ranging signal transmitted by said second system component for receipt by said first system component;

a rebroadcasting of said ranging signal along with a delay metric by said first system component, back to said second system component;

said delay metric being the amount of time said first system component takes to initiate said rebroadcasting; and said computer of said second system component additionally programed to calculate said separation distance from the total time the round trip transmission of said ranging signal and said delay metric.

7. The vehicle communication system of claim 5 additionally comprising:

said first system component installed in a plurality of first vehicles;

said computer of said first system component in each of said plurality of first vehicles each programed with a unique identifier;

said second system component adapted to communicate a unique trigger signal to a respective first system component of any one of said plurality of said first vehicles; and said unique trigger signal activating only one or a plurality of said first system components identified by their respective unique identifier, whereby said second system component may transmit a trigger signal or one or a plurality of first system components in different first vehicles based on their respective unique identifiers.

8. The vehicle communication system of claim 5 additionally comprising:

said trigger signal suppressed should said heading of said first vehicle be away from the direction of travel of said second vehicle whereby said display mode of said first vehicle component is only triggered for first vehicles traveling toward, or in the same general direction, of said second vehicle.

9. The vehicle communication system of claim 6 additionally comprising:

said trigger signal suppressed should said heading of said first vehicle be away from the direction of travel of said second vehicle whereby said display mode of said first vehicle component is only triggered for first vehicles traveling toward, or in the same general direction, of said second vehicle.

10. The vehicle communication system of claim 7 additionally comprising:

said trigger signal suppressed should said heading of any of said plurality of said first vehicles identified by said unique identifier, be away from the direction of travel of said second vehicle whereby said display mode of said first vehicle component is only triggered for first vehicles traveling toward, or in the same general direction, of said second vehicle.

11. The vehicle communication system of claim 5 wherein said means for said second system component to determine the separation distance between said first vehicle and said second vehicle comprises:

said first system component having a first GPS receiver generating a first location identifier;

said second system component having a second GPS receiver generating a second location identifier;

said response signal from said first system component, in said respond mode, transmitting a response signal to said second system component, said response signal including said second location identifier; and said computer of said second system component calculating said separation distance using said first location identifier communicated in said response signal and said second location identifier.

12. The vehicle communication system of claim 11 wherein:

said first location identifier includes the position, heading and speed of said first vehicle;

said second location identifier includes the position, heading, and speed of said second vehicle; and said computer of said second system component programmed to continuously calculate said separation distance in real time and initiate said trigger signal should said separation distance fall into said predetermined parameters, and cease said trigger signal should said separation distance fall outside said predetermined parameters.

13. The vehicle communication system of claim 7 wherein said means for said second system component to determine the separation distance between any of said plurality of said first vehicles and said second vehicle comprises:

each said first system component having a first GPS receiver generating a first location identifier;

said second system component having a second GPS receiver generating a second location identifier;

said response signal from any of said first system components, in said respond mode, transmitting a response signal to said second system component, said response signal including said unique identifier of said individual first vehicle and a second location identifier of said individual first vehicle; and said computer of said second system component calculating said separation distance between said second vehicle and any or all of said plurality of first vehicles using said first location identifier communicated in said response signal and said second location identifier.

14. A vehicle communication system comprising:

a first system component adapted for mounting in a first vehicle, said first system component having a computer operatively programed and interfaced with a plurality of first system components including:

a transceiver;

means to determine the heading of said first vehicle;

means for visual display of indica to the driver of said first vehicle;

a second system component adapted for mounting in a second vehicle, said second system component having a computer operatively programed and interfaced with a plurality of second system components including:

means to determine the directional travel of said second vehicle;

means to broadcast a pilot signal on a pilot channel;

means to receive transmissions from said transceiver;

means to communicate location and directional travel to a remote monitoring station;

means to control intersection signal lights in the direction of travel of said second vehicle;

said first system component having a default mode wherein said transceiver monitors said pilot channel for said pilot signal;

said first system component having a respond mode triggered by receipt of said pilot signal broadcast from said second system component;

said first system component having a display mode, triggered by a second signal from said second system component, wherein said visual display provides a visual warning of the proximity of said second vehicle to said driver of said first vehicle;

said first system component, in said respond mode, transmitting a response signal to said second system component, said response signal including at least said heading of said first vehicle;

means for said second system component to determine the separation distance between said first vehicle and said second vehicle;

a trigger signal broadcast by said second system component, said trigger signal triggering said first system component to said display mode said should said computer of said second system component determine said separation distance falls within predetermined separation parameters; and said second system component continuously updating said remote monitoring station as to location and direction of travel and control said intersection control lights in the direction of travel of said second vehicle.

15. The vehicle communication system of claim 14 further comprising:

said remote monitoring station capable of communicating said location and direction of travel of said second vehicle to one or a plurality of remote additional second vehicles.

* * * * *